United States Patent [19]

Sawada et al.

[11] Patent Number: 4,669,974

[45] Date of Patent: Jun. 2, 1987

[54] LIQUID FUEL COMBUSTION APPARATUS

[75] Inventors: Katsuji Sawada, Tochigi; Kunio Kikuchi, Odawara, both of Japan

[73] Assignee: Mikuni Kogyo Kabushiki Kaisha, Tokyo, Japan

[21] Appl. No.: 726,689

[22] Filed: Apr. 24, 1985

[51] Int. Cl.[4] ..... F23D 11/36

[52] U.S. Cl. ..... 431/154; 431/260; 431/261; 431/263; 431/264

[58] Field of Search ..... 431/154, 194, 260, 261, 431/263, 264; 219/267

[56] References Cited

U.S. PATENT DOCUMENTS

| | | | |
|---|---|---|---|
| 2,194,081 | 3/1940 | Bock | 431/261 |
| 2,471,833 | 5/1949 | McCollum | 431/260 |
| 2,493,743 | 1/1950 | Benson | 431/263 X |
| 2,642,858 | 6/1953 | Plesser et al. | 431/260 X |
| 3,134,423 | 5/1964 | Smith | 431/261 X |
| 3,185,896 | 5/1965 | Gorske et al. | 431/261 |
| 3,989,030 | 11/1976 | Friedl | 431/263 X |
| 4,464,107 | 8/1984 | Boe | 431/264 |

FOREIGN PATENT DOCUMENTS 56-851962 5/1962 Japan .

*Primary Examiner*—Randall L. Green
*Attorney, Agent, or Firm*—Pahl, Lorusso & Loud

[57] ABSTRACT

An improved liquid fuel combustion apparatus of the type including a cylindrical combustion chamber, an ignition plug, an ignition plug mounting sleeve and a heat exchanger is disclosed. The cylindrical combustion chamber and the heat exchanger constituting essential components of the apparatus are separable. The ignition plug mounting sleeve is firmly mounted within coaxially aligned nipples on the heat exchanger and on the combustion chamber so that its inner wall lined with a layer of wick is exposed to the interior of the cylindrical combustion chamber. Typically, the ignition plug mounting sleeve is secured to the mounting seat by securing a flange on the outer surface of the mounting sleeve to mounting seat associated with the nipple of the heat exchanger by means of bolts with a packing interposed therebetween. Alternatively, the mounting sleeve may be threaded into the mounting seat by tightly holding a larger diameter portion of the mounting sleeve between a plate and the end of the nipple of the heat exchanger or by resiliently holding a larger diameter portion of the mounting sleeve with a leaf spring.

11 Claims, 10 Drawing Figures

LIQUID FUEL COMBUSTION APPARATUS

BACKGROUND OF THE INVENTION

1. Field of the Invention

The present invention relates to a liquid fuel combustion apparatus in which liquid fuel is vaporized and thus vaporized fuel is burnt and more particularly to improvement of or relating to a liquid fuel combustion apparatus of the type including an ignition plug mounting sleeve which is secured thereto in an improved manner.

2. Description of the Prior Art

To facilitate understanding of the present invention it will be helpful that a typical conventional liquid fuel combustion apparatus is described below with reference to FIGS. 1 to 3. As will be apparent from the drawings, the conventional apparatus essentially comprises a combustion sleeve 12 with a combustion chamber 10 formed therein, an ignition plug 14, an ignition plug mounting sleeve 16 onto which the ignition plug 14 is removably mounted, the ignition plug mounting sleeve 16 being securely fixed to the combustion sleeve 12 and the inner wall thereof being lined with a layer of wick 15 which functions as fuel firing wick, and an annular heat exchanger 18 through which combustion gas generated in the combustion sleeve 12 is caused to flow. In the conventional apparatus combustion air is fed into the combustion sleeve 12 via a combustion air feeding pipe 20, while fuel of which flow rate is controlled and measured by means of a solenoid valve 22 and a fuel pump 24 is introduced into the ignition plug mounting sleeve 16 via a fuel pipe 26. At the same time a part of combustion air flowing through the combustion air feeding pipe 20 is delivered to the ignition plug mounting sleeve 16 via an air pipe 28.

In the conventional liquid fuel combustion apparatus of the above-described type the heat exchanger 18 is generally welded to the combustion sleeve 12 which defines the combustion chamber 10. Likewise, the ignition plug mounting sleeve 16, through which an ignition plug 14 is mounted, is secured to the combustion sleeve 12 by welding, as typically disclosed in Japanese Patent Publication No. 5685/1962. However, since the components constituting the apparatus are connected or secured to one another by welding in the above-described manner, it has been pointed out that the following problems occur with the conventional apparatus as (1) Welding requires a number of man-hours and leakage tends to occur at the welds.

(2) The elevated temperature developed during welding causes the female thread portion in the ignition plug mounting plug 16 to be undesirably deformed, resulting in difficulty in threading an ignition plug.

(3) The elevated temperature developed during welding causes also undesirable deformation of the combustion sleeve 12. This leads to incorrect orientation of the ignition plug mounting sleeve 16 relative to the direction of flow of combustion air in the combustion sleeve 12. As a result, combustion tends to take place in an incorrect manner.

(4) The inner wall of the ignition plug mounting sleeve 16 is lined with a layer of wick 15 made of asbestos, metallic wire netting or the like each of which functions as firing wick and carbon produced by combustion of liquid fuel tends to be deposited over the layer of wick 15. However, removal of thus deposited carbon is not easily achieved.

(5) During combustion of liquid fuel not only the wick 15 but also the ignition plug mounting sleeve 16 are exposed to the influence of the elevated temperature developed by combustion and therefore they become deteriorated within a shorter period of time than the combustion sleeve 12 and other components. This means that the service life of the whole combustion sleeve is limited by the service life of both the ignition plug mounting sleeve 16 and the wick 15.

SUMMARY OF THE INVENTION

Thus, the present invention has been made with the foregoing problems in mind and its object resides in providing an improved liquid fuel combustion apparatus which makes it possible to easily carry out replacement of components which tend to deteriorate within a short period of time.

Another object of the present invention is to provide an improved liquid fuel combustion apparatus which can be operated at a reduced running cost.

To accomplish the above objects there is proposed according to the invention a liquid fuel combustion apparatus of the type including a cylindrical combustion chamber in which liquid fuel is burnt to generate combustion gas, an ignition plug for igniting the liquid fuel, an ignition plug mounting sleeve with the ignition plug mounted therein, the inner wall of the ignition plug mounting sleeve being exposed to the interior of the cylindrical combustion chamber, and a heat exchanger for heat exchange between the combustion gas and liquid to be heated, wherein the improvement consists in that the cylindrical combustion chamber and the heat exchanger are separable components, that the heat exchanger is formed with a fitting hole into which the ignition plug mounting sleeve is inserted and a mounting seat for the ignition plug mounting sleeve is provided around the fitting hole and that the ignition plug mounting sleeve is removably mounted on the mounting seat by using suitable securing means.

Typically, the securing means comprises a flange made integral with the ignition plug mounting sleeve, a plurality of female thread holes formed on the mounting seat and a plurality of bolts for securing the flange to the mounting seat.

Other objects, features and advantages of the invention will become more clearly apparent from reading of the following description which has been prepared in conjunction with the accompanying drawings.

BRIEF DESCRIPTION OF THE DRAWINGS

The accompanying drawings will be briefly described below.

FIG. 1 is a schematic vertical sectional view of the conventional liquid fuel combustion apparatus.

FIG. 2 is a sectional view of the apparatus taken in line II—II in FIG. 1, and FIG. 3 is a fragmental enlarged sectional view of the apparatus, particularly illustrating how an ignition plug is mounted on the ignition plug mounting sleeve.

FIG. 4 is a vertical sectional view of the apparatus of the invention.

FIG. 5 is a sectional view of the apparatus taken in line III—III in FIG. 4.

FIG. 6 is a fragmental sectional view of the apparatus, particularly illustrating securing means for the ignition plug mounting sleeve in accordance with a first embodiment.

FIG. 7 is a fragmental sectional view of the apparatus, particularly illustrating securing means for the ignition plug mounting sleeve in accordance with a second embodiment.

FIG. 8 is a fragmental sectional view of the apparatus, particularly illustrating securing means for the ignition plug mounting sleeve in accordance with a third embodiment.

FIG. 9 is a cross-sectional view of the apparatus, taken in line IV—IV in FIG. 8, and FIG. 10 is a fragmental sectional view of the apparatus, particularly illustrating securing means for the ignition plug mounting sleeve in accordance with a fourth embodiment.

DESCRIPTION OF THE PREFERRED EMBODIMENTS

Now, the present invention will be described in a greater detail hereunder with reference to FIGS. 4 to 10.

Figure 1:
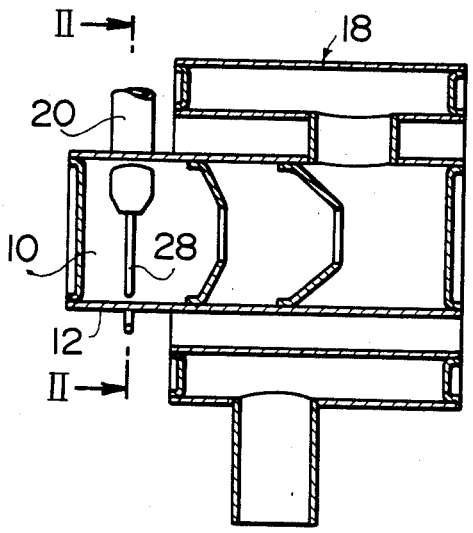
FIG. 1 (PRIOR ART)
FIGS. 1 to 3 schematically illustrate a typical hitherto known liquid fuel combustion apparatus.
Figure 2:
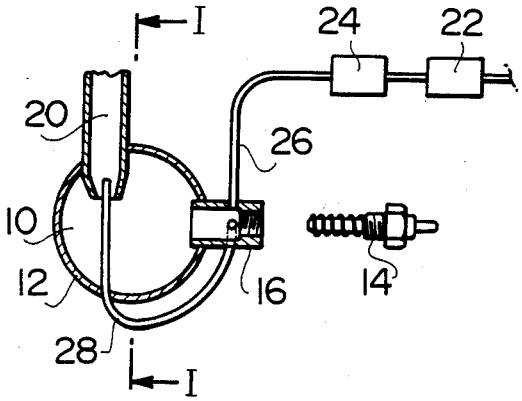
FIG. 2 (PRIOR ART)
Figure 3:
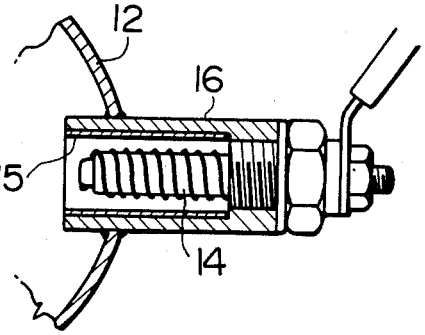
FIG. 3 (PRIOR ART)
Figure 4:
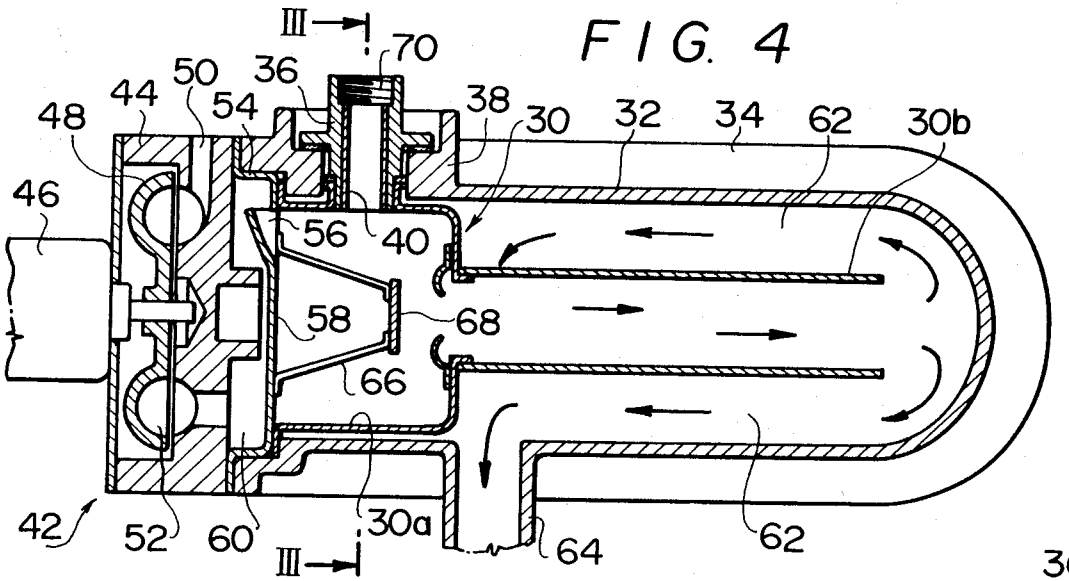
FIGS. 4 to 10 illustrate a liquid fuel combustion apparatus according to the invention.
Figure 5:
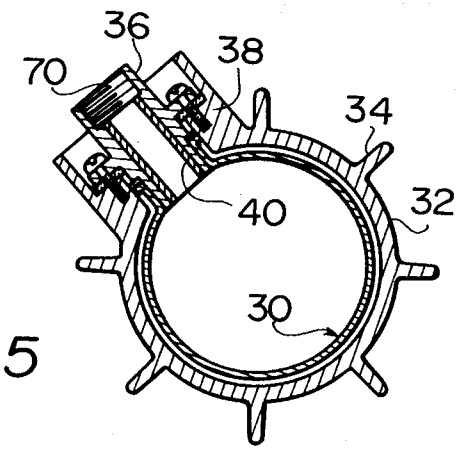

Referring first to FIGS. 4 and 5, a cylindrical combustion chamber 30 made of, for instance, stainless steel is constituted by a combination of an enlarged portion 30*a* in which liquid fuel is burnt and an elongated portion 30*b* having a diameter smaller than that of the enlarged portion 30*a* through which combustion gas is discharged. Both the portions 30*a* and 30*b* are fixedly connected to one another by welding. The apparatus of the invention includes a heat exchanger 32 which serves to effect heat exchange between combustion gas and the liquid to be heated. The heat exchanger 32 is constructed by casting metallic material having excellent heat conductivity, for instance, aluminum or the like material and has a configuration in which one end is closed and the other end is open, as will be apparent from FIG. 4. Further, the heat exchanger 32 is integrally formed with a plurality of heat radiating fins 34 around the outer surface thereof. The elongated portion the 30*b* of the combustion chamber 30 is housed within the heat exchanger 32. Further, the heat exchanger 32 has a mounting seat 38 on which an ignition plug mounting sleeve 36 is mounted. The inner wall surface of the ignition plug mounting sleeve 36 is lined with a layer of wick 40 made of asbestos, metallic wire netting or the like each of which functions as firing wick for initiating combustion of liquid fuel in the combustion chamber 30.

Further, the apparatus of the invention includes a combustion air introducing device 42 for introducing combustion air into the combustion chamber 30. The combustion air introducing device 42 includes the combination of casing 44, motor 46 and rotor 48 adapted to be rotated by the motor 46. The casing 44 has a combustion air inlet port 50 and, outlet port 52 and as the rotor 48 is rotated, combustion air is introduced into the inlet port 50 and then discharged from the outlet port 52.

A skirt 54 is made integral with the lefthand end of the enlarged portion 30*a* constituting the combustion chamber 30, as seen in the drawing, and moreover an end plate 58 with a plurality of combustion air guide ports 56 formed thereon is secured to the lefthand end of the enlarged portion 30*a*. It should be noted that each of the combustion air guide ports 56 has a configuration to cause the combustion air to swirl therethrough. The foremost end of the skirt 54 comes into airtight contact with the casing 44 in such a manner that an annular combustion air passage 60 is formed between the end plate 58 and the casing 44. As combustion air is discharged from the outlet port 52, it is introduced into the enlarged portion 30*a* of the combustion chamber 30 via the annular passage 60 and the guide ports 56. Combustion gas thus generated by combustion of liquid fuel in the enlarged portion 30*a* of the combustion chamber 30 flows forwardly through the enlarged portion 30*b* in the direction as indicated by the arrows in the drawing and it reverses flow at the downstream open end of the elongated portion 30*b*. It flows further through the annular passage 62 between the inner wall surface of the heat exchanger 32 and the outer surface of the combustion chamber 30 and it is discharged to the outside through the exhaust pipe 64 which is made integral with the heat exchanger 32.

As is apparent from the drawing, the end plate 58 is associated with a shielding plate 68 spaced therefrom which inhibits combustion air introduced into the combustion chamber 30 from flowing straight without swirling.

The ignition plug mounting sleeve 36 has a female thread portion 70 on its upper inner wall into which a male thread portion of an ignition plug (not shown) is threaded so as to allow the latter to be mounted on the ignition mounting sleeve 36.

Figure 6:
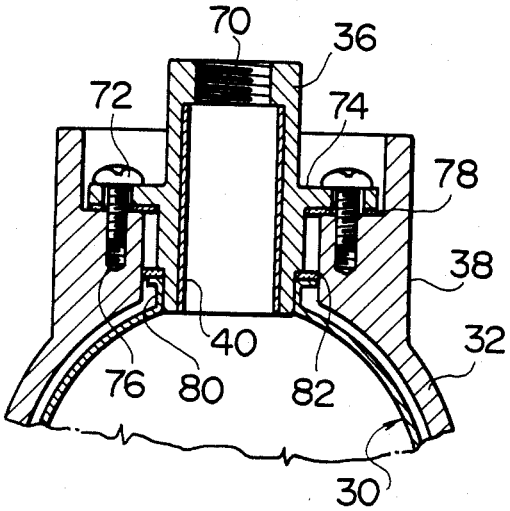

Next, description will be made below as to securing means for the ignition plug mounting sleeve according to the first embodiment with reference to FIG. 6. The securing means is intended to removably secure the ignition plug mounting sleeve 36 to the mounting seat 38 of the heat exchanger 32. The ignition plug mounting sleeve 36 includes a flange 74 at the middle thereof which is formed with a plurality of drilled holes through which fastening bolts 72 are inserted. On the other hand, the mounting seat 38 is formed with the same number of threaded holes as that of the drilled holes on the flange 74 at the position located opposite to them so that the ignition plug mounting sleeve 36 is firmly mounted on the mounting seat 38 by tighening the bolts 72. To assure that no leakage takes place after completion of tightening of the bolts 72, a packing 78 is disposed between the lower surface of the flange 74 and the upper surface of the mounting seat 38 and moreover another packing 82 is disposed between the shoulder on the outer surface of the ignition plug mounting sleeve 36 located in the proximity of the lower end of the latter and the upper end face of the cylindrical portion 80 extending upwardly from the combustion chamber 30. It should be noted that the components in FIG. 6 identical to as those in FIGS. 4 and 5 are identified by same reference numerals.

Figure 7:
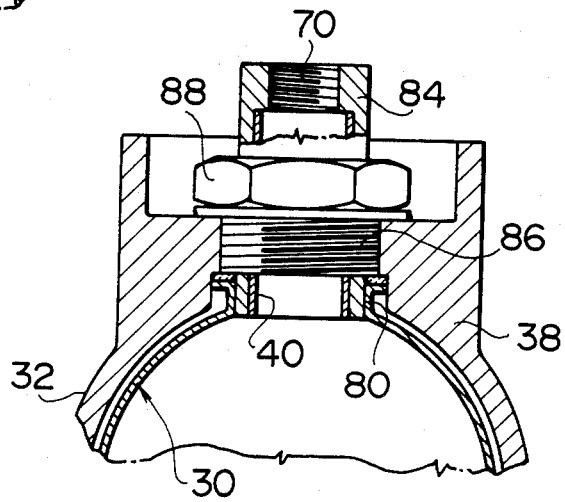

Next, a second embodiment of a securing means for the ignition plug mounting sleeve according will be described with reference to FIG. 7. The ignition plug mounting sleeve 84 has a male thread portion 86 on the outer surface thereof which is threaded into a female thread portion on the inner wall of the mounting seat 38. Securing of the ignition plug mounting sleeve 84 to the mounting seat 38 is achieved by fitting the male thread portion of the ignition plug mounting sleeve 84 into the female thread portion of the mounting seat 38 and then threadably engaging a lock nut 88 onto the male thread portion 86 of the ignition plug mounting sleeve 84 until the latter is firmly mounted on the mounting seat 38.

Figure 8:
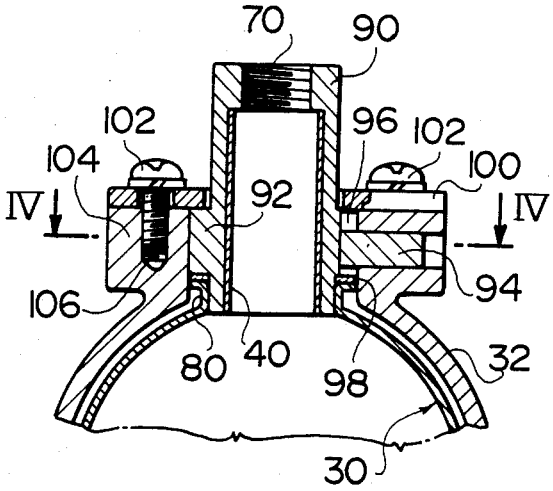
Figure 9:
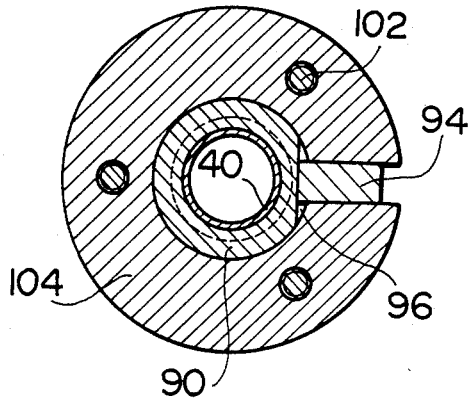

Next, a third embodiment for securing the ignition plug mounting sleeve will be described with reference to FIG. 8. The ignition plug mounting sleeve 90 includes a larger diameter portion 92 on the outer surface thereof which is formed with a groove 96 parallel to the axis of the ignition plug mounting sleeve 90 (the direction of the center line). The groove 96 is adapted to receive therein a turn prevention member 94 which prevents the ignition plug mounting sleeve 90 from turning when securing an ignition plug (not shown) to the ignition plug mounting sleeve 90. A packing 98 is disposed between the lower surface of the larger diameter portion 92 and the upper end surface of the cylindrical portion extending upwardly from the combustion chamber 30. The upper surface of the larger diameter portion 92 is secured by means of a plate 100 having a plurality of drilled holes through which fastening bolts 102 are inserted into mating threaded holes 106 in the mounting seat 104. Thus, the ignition plug mounting sleeve 90 is fixedly secured to the mounting seat 104 by tightening the bolts 102.

Figure 10:
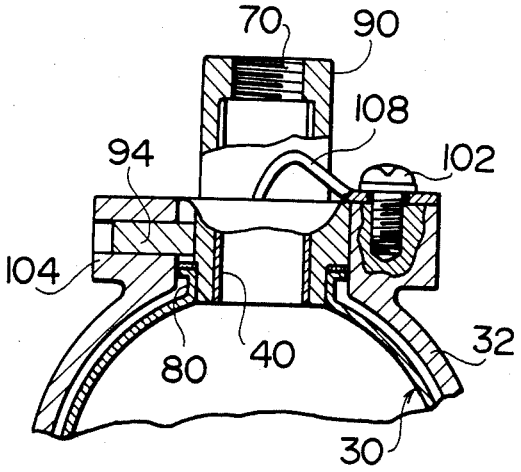

Finally, a fourth embodiment for securing the ignition plug mounting sleeve will be described with reference to FIG. 10. This embodiment is substantially the same as the third embodiment with the exception that the upper end surface of the larger diameter portion 92 of the ignition plug mounting sleeve 90 is secured by means of a leaf spring 108, not by means of the plate 100 as in the third embodiment.

As will be readily understood from the above description, a characterizing feature of the liquid fuel combustion apparatus of the invention is that the heat exchanger and the cylindrical combustion chamber are arranged separately from one another and the ignition plug mounting sleeve is fitted to the heat exchanger so that an ignition plug is exposed to the cylindrical combustion chamber. By virtue of such an arrangement, it is possible to mount the ignition plug mounting sleeve onto the heat exchanger without the necessity of welding the former directly to the cylindrical combustion chamber as is the case with the conventional apparatus.

Accordingly, there is no requirement for a large amount of man-hours for welding and the danger of leakage of air or combustion gas and undesirable deformation of components due to welding, as is often seen in the conventional apparatus is avoided. Another advantageous features of the apparatus of the invention is that the ignition plug mounting sleeve can be easily replaced with a new one and moreover it can be easily maintained and inspected, resulting in elongated service life.

While the present invention has been described above with respect to four preferred embodiments, it should of course be understood that it should not be limited only to them but various changes or modifications may be made in any acceptable manner without departure from the spirit and scope of the invention as defined by the appended claims.

What is claimed is:

1. A liquid fuel combustion apparatus comprising: wall means defining a cylindrical combustion chamber, a cylindrical portion of said wall means having a first port therein for receiving an ignition device and a first nipple integral with said wall means and surrounding said first port:

means for introducing fuel and combustion air into said combustion chamber and for removing the products of combustion therefrom;

a cylindrical heat exchanger detachably mounted on and surrounding said combustion chamber for receiving and directing the products of combustion and carrying a plurality of heat radiating fins on its outer surface, said heat exchanger having a second port extending through a cylindrical wall thereof and a second nipple integral with and surround said second port, said second port being axially aligned with said first port when said combustion chamber and said heat exchanger are assembled together;

an ignition device mounting sleeve, said first and second nipples being adapted to receive said ignition device mounting sleeve therein; and securing means for securing said ignition mounting sleeve within said first and second nipples in such a manner that said mounting sleeve, said combustion chamber and said heat exchanger are thereby releasably secured together.

2. A liquid fuel combustion apparauts in accordance with claim 1 wherein said second nipple provides a seat and said mounting sleeve has an integral flange which mates with said seat.

3. A liquid fuel combustion apparatus in accordance with claim 2 wherein said seat is provided with a plurality of threaded holes, said flange is provided with a plurality of holes mating with said threaded holes and said securing means comprises a number of bolts which thread into said threaded holes.

4. A liquid fuel combustion apparatus in accordance with claim 2 wherein said seat is formed in a recess in the distal end of said second nipple.

5. A liquid fuel combustion apparatus in accordance with claim 2 wherein said mounting sleeve and said second nipple have mating threaded portions.

6. A liquid fuel combustion apparatus in accordance with claim 5 wherein said mounting sleeve comprises a reduced diameter portion fitted within said first nipple and joined to the threaded portion to form a shoulder therebetween, said first nipple bearing against said shoulder when said mounting sleeve is threaded within said second nipple.

7. A liquid fuel combustion apparatus in accordance with claim 1 wherein said mounting sleeve has opposite end portions of smaller diameter than a central portion of said mounting sleeve, said central portion forming a shoulder one of said end portions being mounted within said first nipple and said shoulder being fitted within said second nipple.

8. A liquid fuel combustion apparatus in accordance with claim 7 wherein said securing means comprises a removable flange surrounding an upper end of portion of said mounting sleeve and bearing against said shoulder and bolts securing said removable flange to said second nipple.

9. A liquid fuel combustion apparatus in accordance with claim 8 wherein said securing means further comprises means for preventing said sleeve from rotating within said first and second nipples.

10. A liquid fuel combustion apparatus in accordance with claim 7 wherein said securing means comprises a leaf spring with one end affixed to said second nipple and the opposite end bearing against an upper surface of said shoulder.

11. A liquid fuel combustion apparatus in accordance with claim 1 further comprising a liquid fuel wicking material lining at least a portion of said mounting sleeve.

* * * * *

UNITED STATES PATENT AND TRADEMARK OFFICE

CERTIFICATE OF CORRECTION

PATENT NO. : 4,669,974

DATED : June 2, 1987

INVENTOR(S) : Katsuji Sawada et al.

It is certified that error appears in the above-identified patent and that said Letters Patent is hereby corrected as shown below:

Column 6, line 10, "surround" should read -- surrounding --.

Column 6, line 48, after "shoulder" insert -- , --.

Signed and Sealed this

Twenty-ninth Day of September, 1987

*Attest:*

DONALD J. QUIGG

*Attesting Officer* *Commissioner of Patents and Trademarks*